US006698361B2

(12) United States Patent
Lung

(10) Patent No.: US 6,698,361 B2
(45) Date of Patent: Mar. 2, 2004

(54) FOLDABLE DESK

(76) Inventor: Hsin-Liang Lung, 11F-2, No.43, Chai-I Street, Taichung City (TW)

( * ) Notice: Subject to any disclaimer, the term of this patent is extended or adjusted under 35 U.S.C. 154(b) by 0 days.

(21) Appl. No.: 10/053,806

(22) Filed: Jan. 24, 2002

(65) Prior Publication Data

US 2003/0136308 A1 Jul. 24, 2003

(51) Int. Cl.[7] ..... A47B 37/00
(52) U.S. Cl. ..... 108/50.17; 108/118
(58) Field of Search ..... 108/12, 18, 118, 108/177, 162

(56) References Cited

U.S. PATENT DOCUMENTS 4,471,969 A * 9/1984 Zabala et al. ..... 280/30
4,850,286 A * 7/1989 Cline ..... 108/118
5,092,615 A * 3/1992 Gregalis ..... 280/30

FOREIGN PATENT DOCUMENTS

GB 2216073 A * 10/1989 ..... A47B/3/02

* cited by examiner

*Primary Examiner*—Lanna Mai
*Assistant Examiner*—Jerry Anderson
(74) *Attorney, Agent, or Firm*—Charles E. Baxley

(57) ABSTRACT

A foldable desk includes a top and a first leg and a second leg are respectively and pivotally connected to an underside of the top. Two rollers are connected to the underside of the top and one of the first leg and the second leg has two rollers connected thereto. The two legs can be pivoted parallel to the top and the rollers on the top and one of the two legs may roll on the ground.

2 Claims, 5 Drawing Sheets

FOLDABLE DESK

FIELD OF THE INVENTION

The present invention relates to a foldable desk wherein the legs can be folded under the top and have rollers so that the folded status of the desk can be used as a slide bench.

BACKGROUND OF THE INVENTION

A conventional foldable desk generally includes a top and two legs which are respectively and pivotally connected to an underside of the top so that the two legs can be pivoted when the desk is not in use. The foldable legs make the space that the desk occupies is reduced. The foldable desk is usually used as a picnic desk and can be conveniently put in a car trunk. However, the legs cannot be folded to be flat so that it still occupies a certain amount of space. Besides, it is difficult to overlap two or more than two desk within a limited space.

SUMMARY OF THE INVENTION

In accordance with one aspect of the present invention, there is provided a foldable desk which comprises a top and two rollers are connected to an underside of the top. A first leg and a second leg are respectively and pivotally connected to an underside of the top. One of the first leg and the second leg has two rollers connected thereto.

The primary object of the present invention is to provide a foldable desk that has rollers when the desk is folded as a flat combination.

Another object of the present invention is to provide a foldable desk wherein the top has recesses for receiving rollers of another desk that is overlapped thereto.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
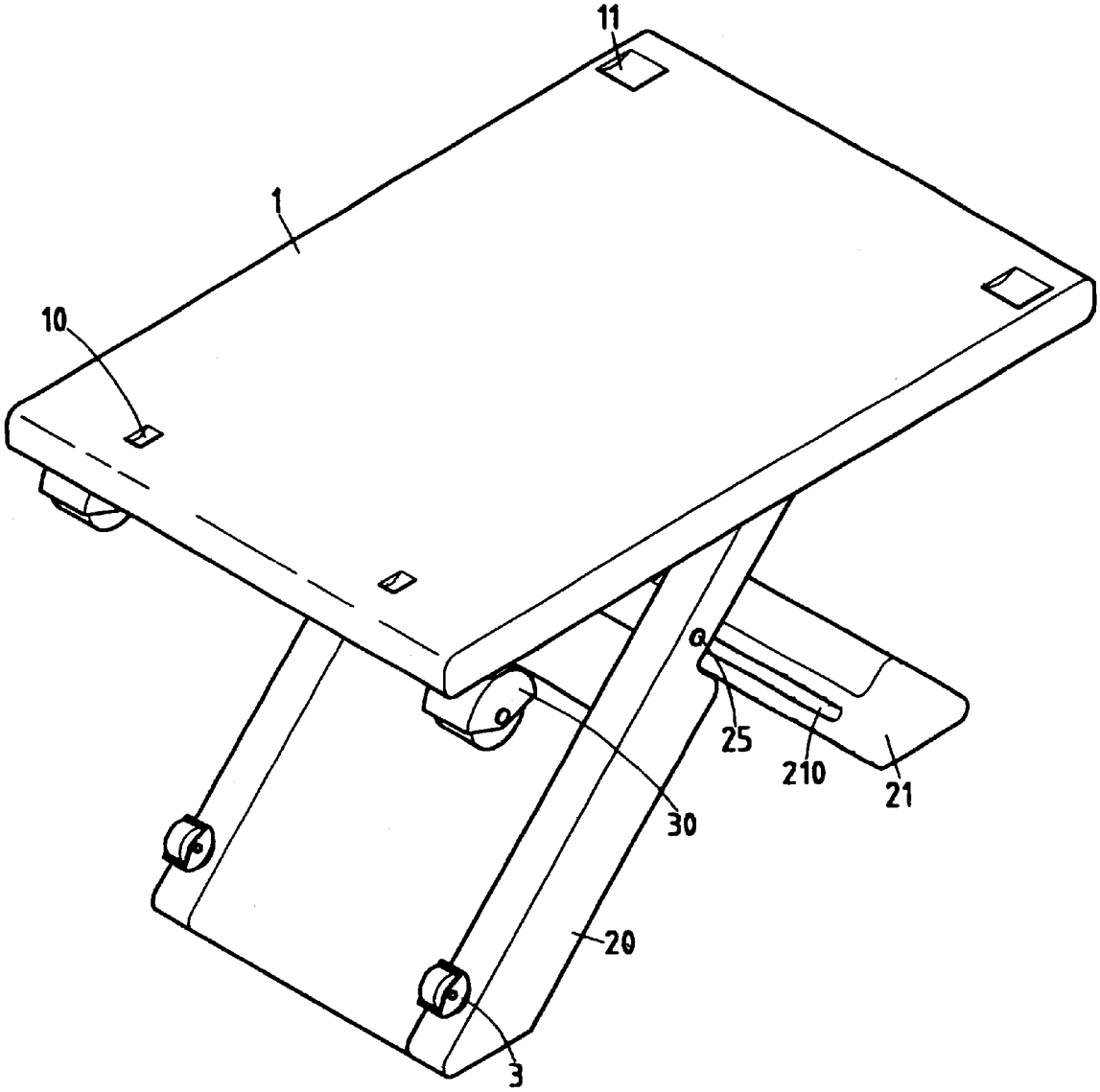
FIG. 1 is a perspective view to show a foldable desk of the present invention.

The first opening 13 is defined by two opposite surfaces and a U-shaped inside connected between the two opposite surfaces. Each of the two opposite surfaces includes a plurality of stepped surfaces 132 and the U-shaped inside includes a plurality of stepped areas 133 which are connected between the stepped surfaces 132. The stepped surfaces 132 and the stepped areas 133 are complied with the sizes of the hex wrenches 30 to be engaged therewith. The sizes of the stepped surfaces 132 and the stepped areas 133 are located in sequences so that the larger stepped surfaces 132 and stepped areas 133 are located close to the end of the tubular body 10. A plurality of holes 12 are defined in the end 11 of the body 10. A passage 12' is defined longitudinally through the tubular body 10.

Figure 2:
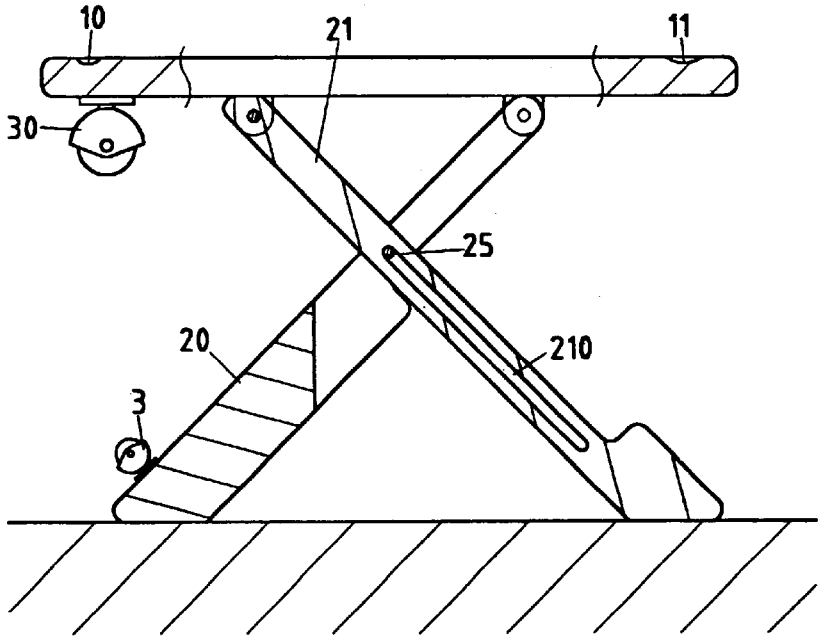
FIG. 2 is a cross sectional view to show the foldable desk of the present invention.

The first leg 20 has two rollers 3 connected thereto and the rollers 3 face the rollers 30 when the desk is expanded as shown in FIG. 2. The top 1 has four two recesses 10, 11 defined in a top surface thereof.

Figure 3:
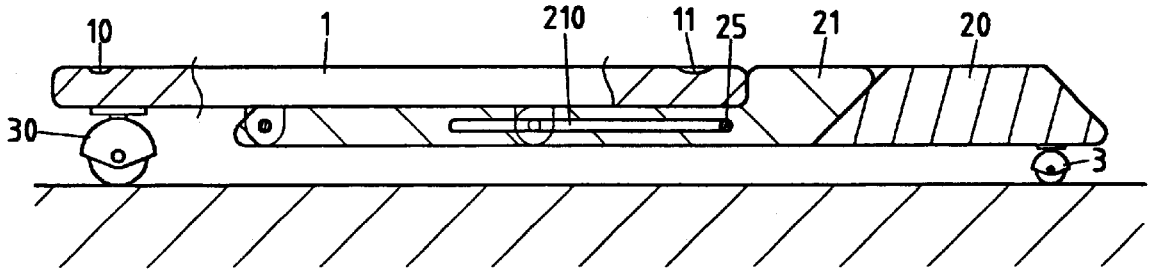
FIG. 3 is a cross sectional view to show the foldable desk of the present invention wherein the two legs are folded and rollers contact the ground.

As shown in FIG. 3, when the first leg 20 and the second leg 21 are pivoted to a position parallel to the top 1, the pin 25 moves to the other end in the groove 210 and the rollers 3 and the rollers 30 contact the ground, and the folded combination of the foldable desk is in a flat status.

Figure 4:
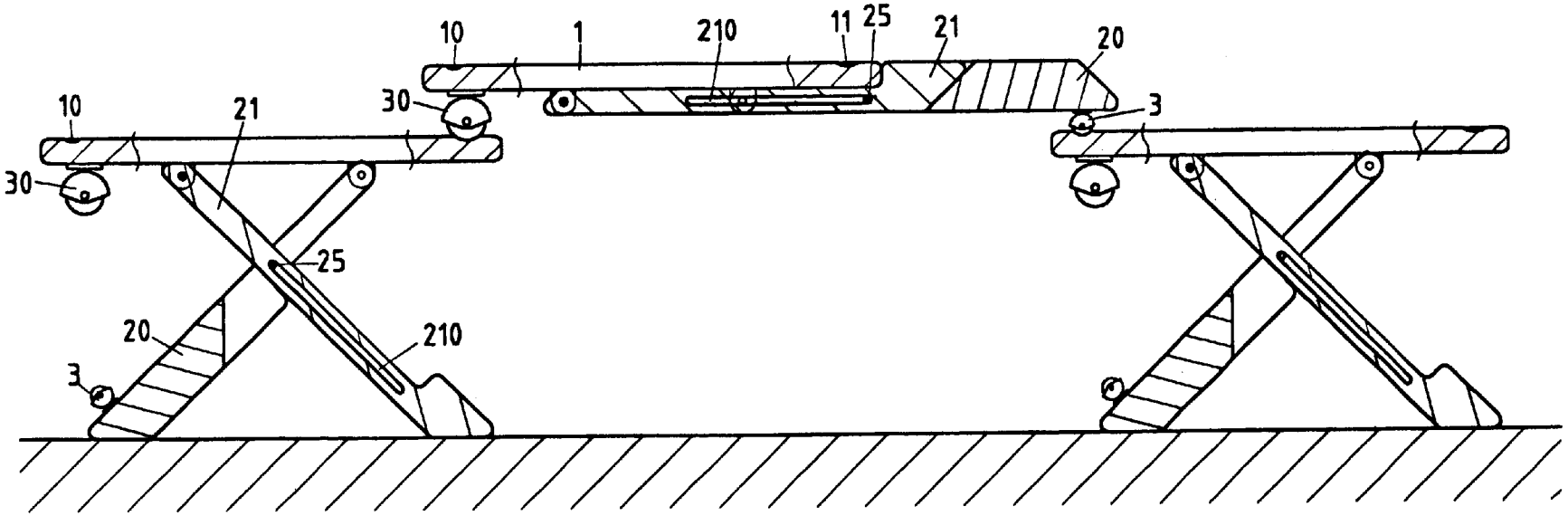
FIG. 4 shows one folded desk is bridged between two desks of the present invention.

As shown in FIG. 4, one folded desk can be bridged between two expanded desks by engaging the rollers 30 in the recesses 10 and 11 of the other two expanded desks.

Figure 5:
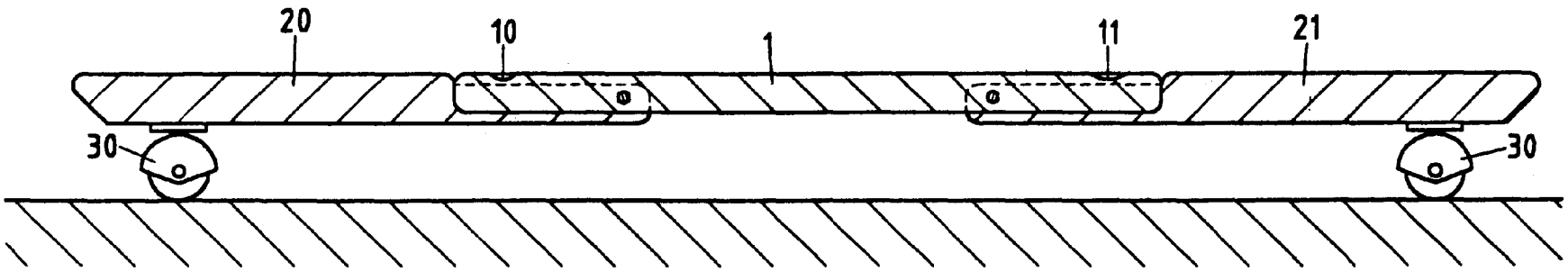
FIG. 5 is a cross sectional view to show another embodiment of the foldable desk of the present invention.

As shown in FIG. 5 which shows another embodiment of the foldable desk wherein the top 1 has no rollers and the first leg 20 and the second leg 21 each have rollers 3. The two legs 20, 21 are pivotally outward and toward two ends of the top 1 as shown. The rollers 3 contact the ground so that the folded combination can be moved on the ground by the rollers 3.

Figure 6:
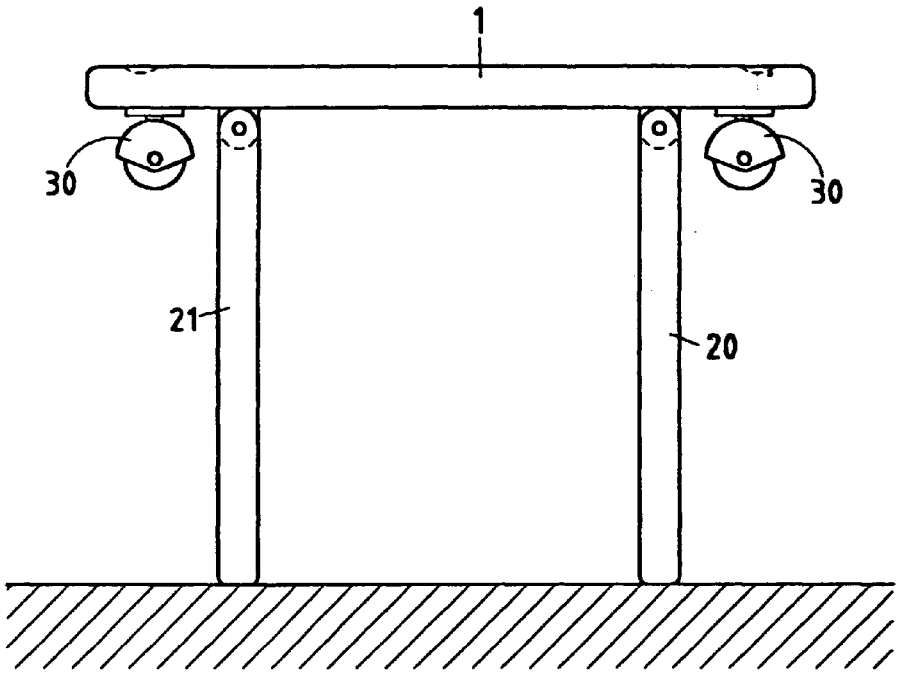
FIG. 6 is a cross sectional view to show yet another embodiment of the foldable desk of the present invention.
Figure 7:
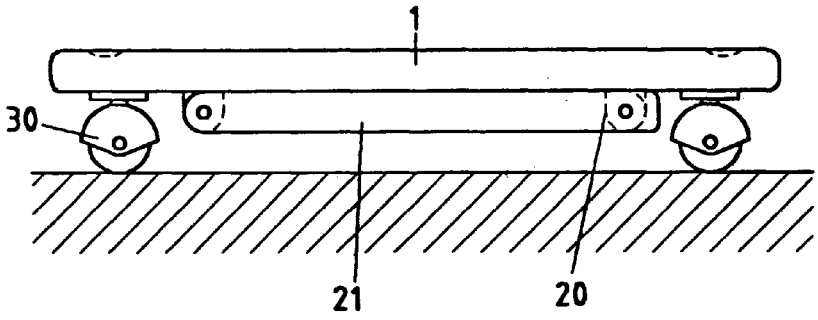
FIG. 7 shows the desk as shown in FIG. 6 is folded.

FIG. 6 shows that the two legs 20, 21 have no rollers thereon and two set of rollers 30 are connected to an underside of two ends of the top 1. When the two legs 20, 21 are folded, the two rollers 30 contact the ground as shown in FIG. 7.

While we have shown and described the embodiment in accordance with the present invention, it should be clear to those skilled in the art that further embodiments may be made without departing from the scope of the present invention.

What is claimed is:

1. A foldable desk comprising:

a top and two rollers connected to an underside of said top, and a first leg and a second leg respectively and pivotally connected to an underside of said top, said second leg having a groove defined longitudinally therethrough and said first leg having a pin which is movably engaged with said groove, the first leg and the second leg being crossed with each other, one of said first leg and said second leg having two rollers connected to a side surface thereof, the two rollers of one of the first leg and the second leg facing the two rollers on the underside of the ton.

2. The desk as claimed in claim 1, wherein said top has at least two recesses defined in a top surface thereof.

* * * * *